US006308884B1

(12) United States Patent
Hamburger

(10) Patent No.: US 6,308,884 B1
(45) Date of Patent: Oct. 30, 2001

(54) DEVICE AND METHOD FOR SUSPENDING A FLAG DISPLAY FROM A MAILBOX

(76) Inventor: Robert Hamburger, 709 Lawn Ave., Sellersville, PA (US) 18960

( * ) Notice: Subject to any disclaimer, the term of this patent is extended or adjusted under 35 U.S.C. 154(b) by 0 days.

(21) Appl. No.: 09/449,990

(22) Filed: Nov. 26, 1999

(51) Int. Cl.[7] ..... B65D 91/00
(52) U.S. Cl. ..... 232/38; 232/39
(58) Field of Search ..... 232/38, 39, 34, 232/35, 17, 45; 116/173, 174

(56) References Cited

U.S. PATENT DOCUMENTS

| | | | | |
|---|---|---|---|---|
| 808,764 | * | 1/1906 | Larsh | 232/39 |
| 1,495,741 | * | 5/1924 | Higdon, Jr. | 232/39 |
| 3,602,424 | * | 8/1971 | Raulston | 232/35 |
| 4,279,380 | * | 7/1981 | Husted | 232/35 |
| 4,813,595 | | 3/1989 | Johns, Jr. et al. . | |
| 4,864,962 | * | 9/1989 | Kuehl et al. | 116/174 |
| 4,895,299 | * | 1/1990 | Okunami | 232/35 |
| 4,953,783 | * | 9/1990 | Chambers | 232/35 |
| 5,000,379 | | 3/1991 | LaRue . | |
| 5,291,849 | * | 3/1994 | Zeitler | 116/174 |
| 5,533,464 | * | 7/1996 | Todd | 116/174 |
| 5,984,172 | * | 11/1999 | Easterwood | 232/38 |

* cited by examiner

*Primary Examiner*—Lynne H. Browne
*Assistant Examiner*—William L. Miller
(74) *Attorney, Agent, or Firm*—LaMorte & Associates

(57) ABSTRACT

A system and method of attaching a flag display to a mailbox in a manner that enables the flag display to hang below the mailbox. The system includes a flag display that has a length equivalent to the sum of the combined lengths of the two sides of the mailbox and the front of the mailbox. The top edge of the flag display attaches to the exterior of the mailbox, near its base. The flag display attaches to the mailbox using hook and loop material or some other equivalent fastening means. The flag display hangs down from the base of the mailbox while maintaining the generally rectangular configuration of the mailbox base. At the bottom of the flag display, the flag display is either weighted or anchored to the mailbox post.

14 Claims, 5 Drawing Sheets

DEVICE AND METHOD FOR SUSPENDING A FLAG DISPLAY FROM A MAILBOX

BACKGROUND OF THE INVENTION

1. Field of the Invention

In general, the present invention relates to displays and flags. More particularly, the present invention relates to displays and flags that are supported by mailboxes.

2. Description of the Prior Art

Most individual homes have mailboxes. In some communities where mail is delivered by truck, the mailbox is a freestanding roadside mailboxes. Such mailboxes are placed along the side of the road to enable a mail carrier in a mail truck to deposit mail into the mailbox without having to leave the driver's seat of that mail truck. In other communities, where the mail is delivered by a walking mail carrier, mailboxes are commonly mounted to the house near the front door.

Over the years people have used their mailboxes as a venue for self-expression and art. Mailboxes have been shaped into thousands of different objects and have been decorated in countless different ways. In some instances, the mailbox itself is an insufficient medium of expression. Consequently, auxiliary attachments for mailboxes have been developed as a means of decorating the mailbox. Many such prior art devices include decorative removable covers for mailboxes that enable a person to change the decorations of their mailbox on a day-to-day basis. Such prior art systems are exemplified by U.S. Pat. No. 5,000,379 to LaRue, entitled, Mail Box Cover; and U.S. Pat. No. 4,815,595 to Johns, entitled Mailbox For Receiving Decorative Overlays. A problem associated with such prior art systems is that the decorative cover for the mailbox covers the exterior of the mailbox, thereby obscuring the mailbox and any display of address that may be printed on the mailbox.

The present invention is a new device and method of decorating a mailbox in a manner that enables a person to quickly and easily change the shown design. The present invention design enables a mailbox to be uniquely decorated with a flag display in a manner that does not obscure the mailbox or any feature that may be painted on the mailbox. The display flag can be decorative or may contain advertisements or other information.

SUMMARY OF THE INVENTION

The present invention is a system and method of attaching a flag display to a mailbox in a manner that enables the flag display to hang below the mailbox. The system includes a flag display that has a length equivalent to the sum of the combined lengths of the two sides of the mailbox and the front of the mailbox. The top edge of the flag display attaches to the exterior of the mailbox, near its base. The flag display attaches to the mailbox using hook and loop material or some other equivalent fastening means. The flag display hangs down from the base of the mailbox while maintaining the overall shape of the bottom of the mailbox. When applied to a roadside mailbox, the bottom of the flag display is weighted, tied and/or anchored to the mailbox post.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
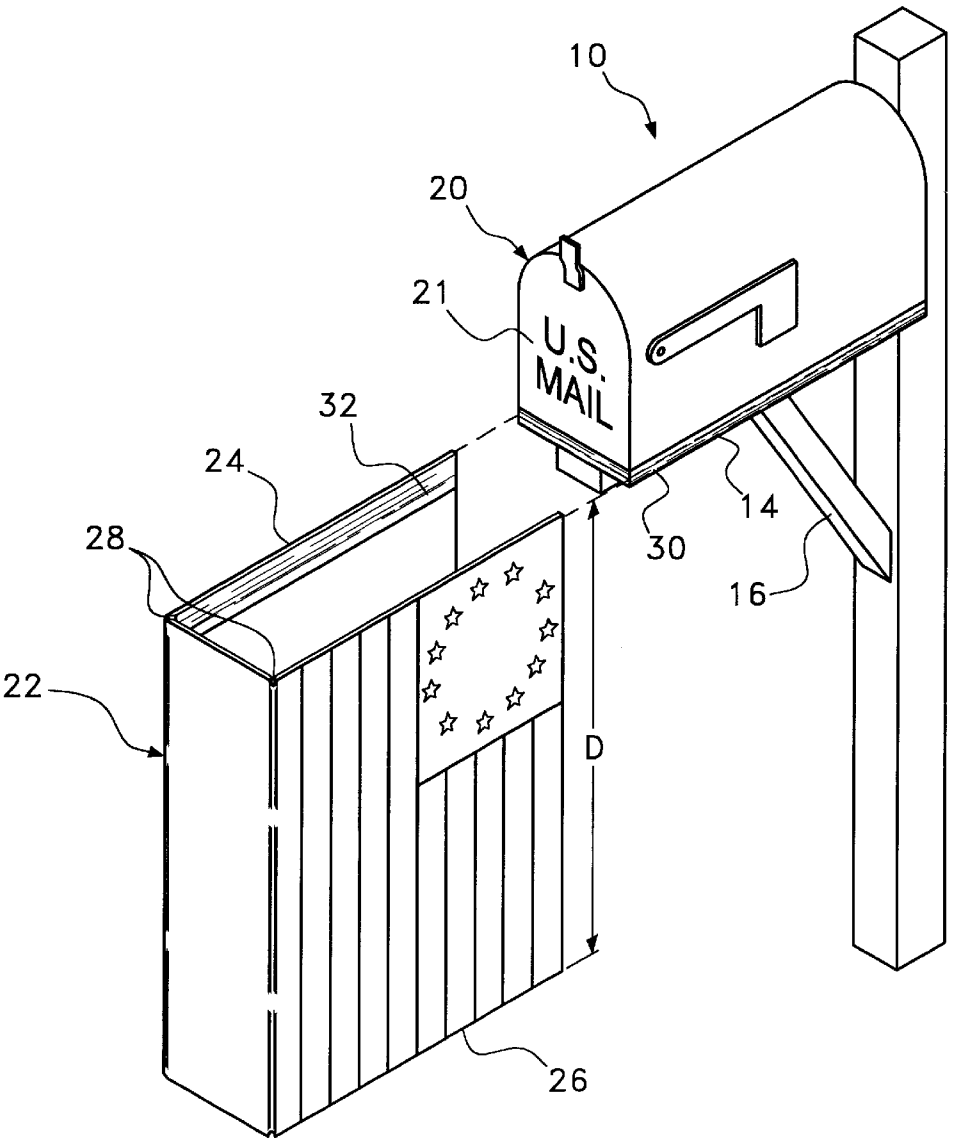
FIG. 1 is a perspective view of an exemplary embodiment of the present invention shown in conjunction with a freestanding roadside mailbox.

Referring To FIG. 1, a traditional roadside mailbox construction 10 is shown. In such a construction, a vertical post 12 is set into the ground. Typically at some point above the ground, a horizontal post 14 extends from the vertical post 12. The horizontal post 14 is typically reinforced by some type of bracket 16. A mailbox 20 is mounted on the horizontal post 14. The mailbox 20 is mounted with the door of the mailbox 20 facing the road so that the mailbox 20 can be accessed by the mail carrier.

The present invention is a system and method of hanging a flag display from the traditional mailbox construction just described. The present invention system includes a flag display 22 that attaches to the bottom of the mailbox 20 and hangs below the mailbox 20. Accordingly, the present invention system does not obstruct the exterior of the mailbox 20, which may be decorated and commonly displays the name and/or address of the owner of the mailbox 20.

The flag display 22 can have any design, symbols or wording desired by the owner. The flag display can be decorative or can contain information, such as advertisements, a corporate sign or the like. In FIG. 1, an original American flag is shown by way of example. The flag display 22 has a top edge 24 and a bottom edge 26. The distance D between the top edge 24 and the bottom edge 26 is preferably between one foot and three feet, but other lengths can be used. The flag display 22 has an overall length, as measured along either the top edge 24 or the bottom edge 26. The length corresponds to twice the side length plus the width of the mailbox 20 being used. Consequently, the flag display 22 is capable of wrapping around three of the four sides of the base of the mailbox 20.

To cause the flag display 22 to conform to the shape of the mailbox 20, the flag display 22 must be folded at a right angle in two places. The flag display, therefore passes over the bottom of the access door 21 to the mailbox 20. To prevent the presence of the flag display from obstructing the mailbox access door 21, corner reliefs 28 are fabricated within the top edge 24 of the flag display 22. The corner reliefs 28 correspond in position to the bottom edge of the mailbox access door 21 and enables the mailbox access door 21 to be opened without obstruction.

The top edge 24 of the flag display 22 attaches to the exterior of the mailbox 20 along its base. The attachment of the flag display 22 to the mailbox 20 is done using a mechanical fastening system. The mechanical fastening system can be snaps, hooks and grommets, laces and holes, a zipper, or the like. However, in the shown exemplary embodiment, opposing sections of hook and loop fastening material are used. Strips of hook and loop fastening material 30 are preferably adhesively attached to the base of the mailbox 20. However, the strips of hook and loop fastening material can be held in place with mechanical fasteners, such as screws or rivets. Opposing strips of hook and loop material 32 are either adhesively or mechanically joined to the interior of the flag display 22 near the top edge 24. Accordingly, when the top edge 24 of the flag display 22 is brought into contact with the base of the mailbox 20, the top edge 24 of the flag display 22 attaches to the mailbox 20.

Since there is nothing below the peripheral edges of the mailbox 20, the flag display 22 hangs freely below the mailbox 20. To change the design of the flag display 22, one flag display is removed from the mailbox and another flag display is substituted in its place.

The bottom edge 26 of the flag display 22 may hang freely and ruffle in the wind. However, it is preferred that the bottom edge 26 of the flag display 22 be either anchored or weighted to provide the flag display 22 with a definable shape.

Figure 2:
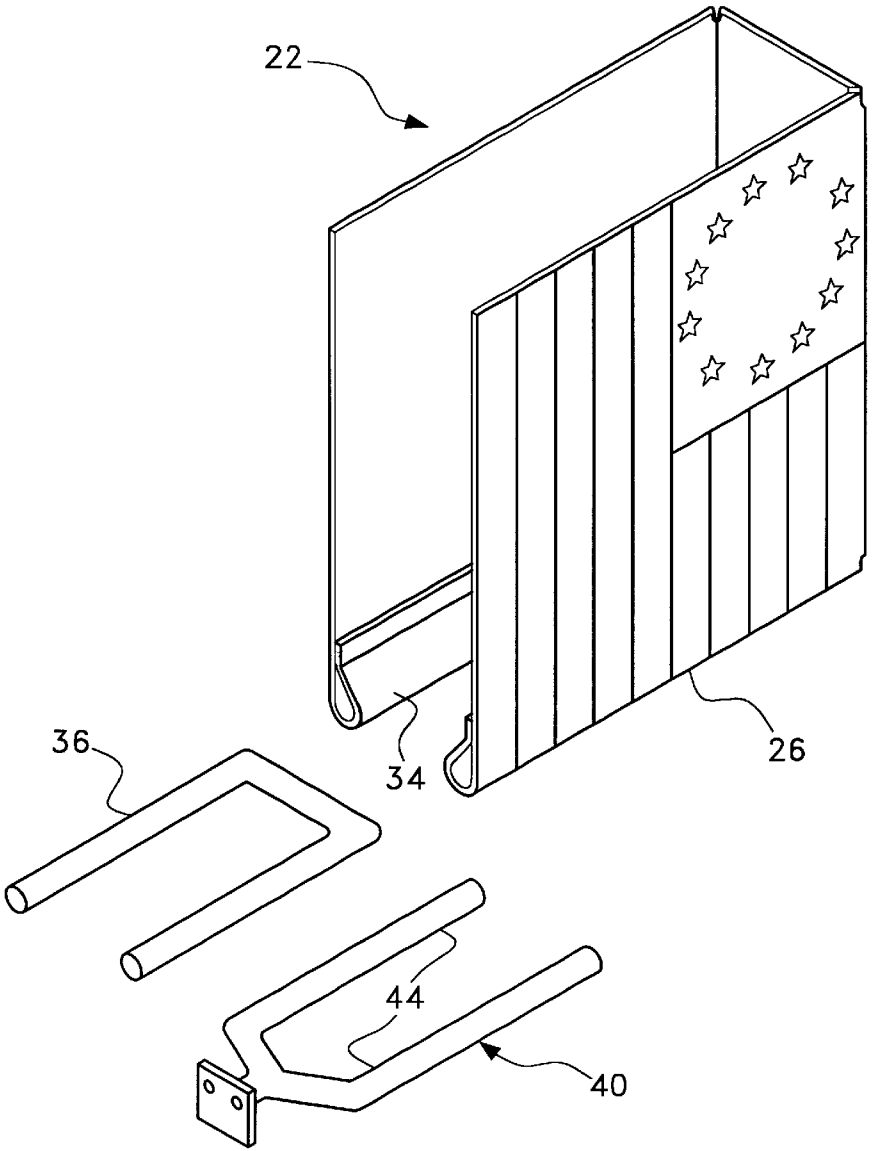
FIG. 2 is a rear perspective view of the flag skirt shown in FIG. 1, shown in conjunction with two embodiments of bottom edge attachments.

Referring to FIG. 2, a rear view of the flag display 22 is shown. A tubular conduit 34 is sewn at the bottom edge 26 of the flag display 22. The sewn conduit 34 is open at both ends. A weight 36 can be placed in the sewn conduit 34. The weight 36 is shaped in the rectangular pattern desired for the bottom edge of the flag display 22. Once present in the sewn conduit 34, the weight 36 maintains the bottom edge 26 of the flag display 22 in the same rectangular shape as the bottom of the mailbox 20 (FIG. 1). The weight 36 also prevents the flag display 22 from blowing freely in the wind and detaching from the mailbox 20 (FIG. 1).

Also shown in FIG. 2 is an optional bottom bracket 40 that can be used in place of the weight. The bottom bracket 40 has a mounting base 42 that connects to the vertical post 12 (FIG. 1) of the mailbox construction. Two arms 44 extend from the mounting base 42. The two arms engage the sewn conduit 34 of the flag skirt 22 at opposite ends. The bottom bracket 40 therefore maintains the bottom edge 26 of the flag display 22 in the desired rectangular shape while simultaneously anchoring the bottom edge 26 of the flag display 22 to the vertical post 12 (FIG. 1) of the mailbox construction. The bottom bracket 40 can be made to be adjustable in length and/or width, so that one bottom bracket can be adapted for use with different flag displays.

Figure 3:
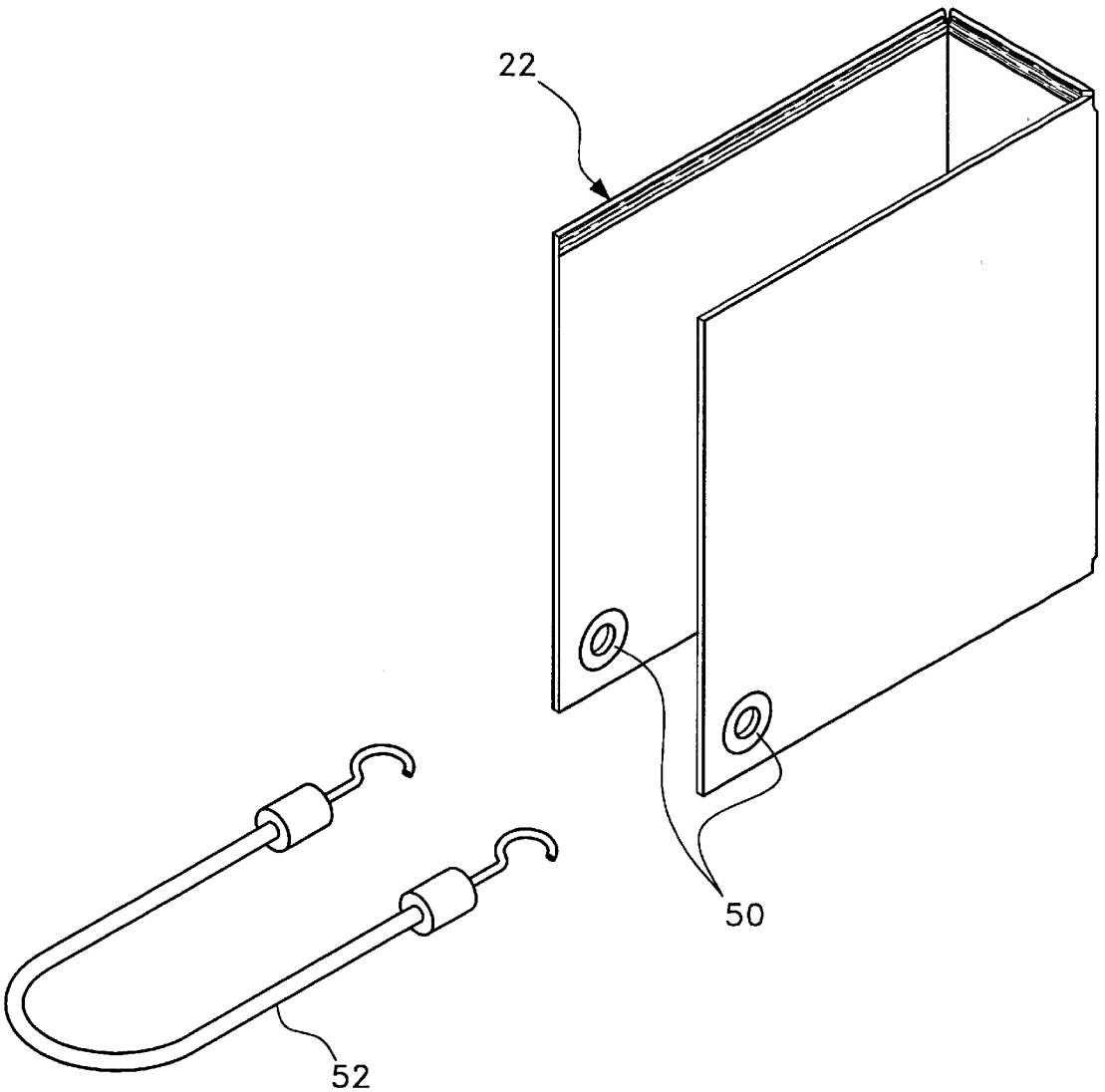
FIG. 3 is a rear perspective view of an alternate exemplary embodiment of the present invention.

Referring to FIG. 3 an alternative method for affixing the bottom of a flag display 22 to a mail post is shown. In this embodiment, two grommets 50 are formed on the flag display 22. The grommets 50 are located near the bottom corners of the flag display 22. A fastener 52 is used to engage the grommets 50 and interconnect the bottom of the display flag to a mail post. The fastener can be a chain, elastic cord or any other flexible band. It should be understood that the use of grommets is merely optional and that flexible bands can interconnect with the display flag 22 in other ways including being sewn directly onto the display flag 22.

Figure 4:
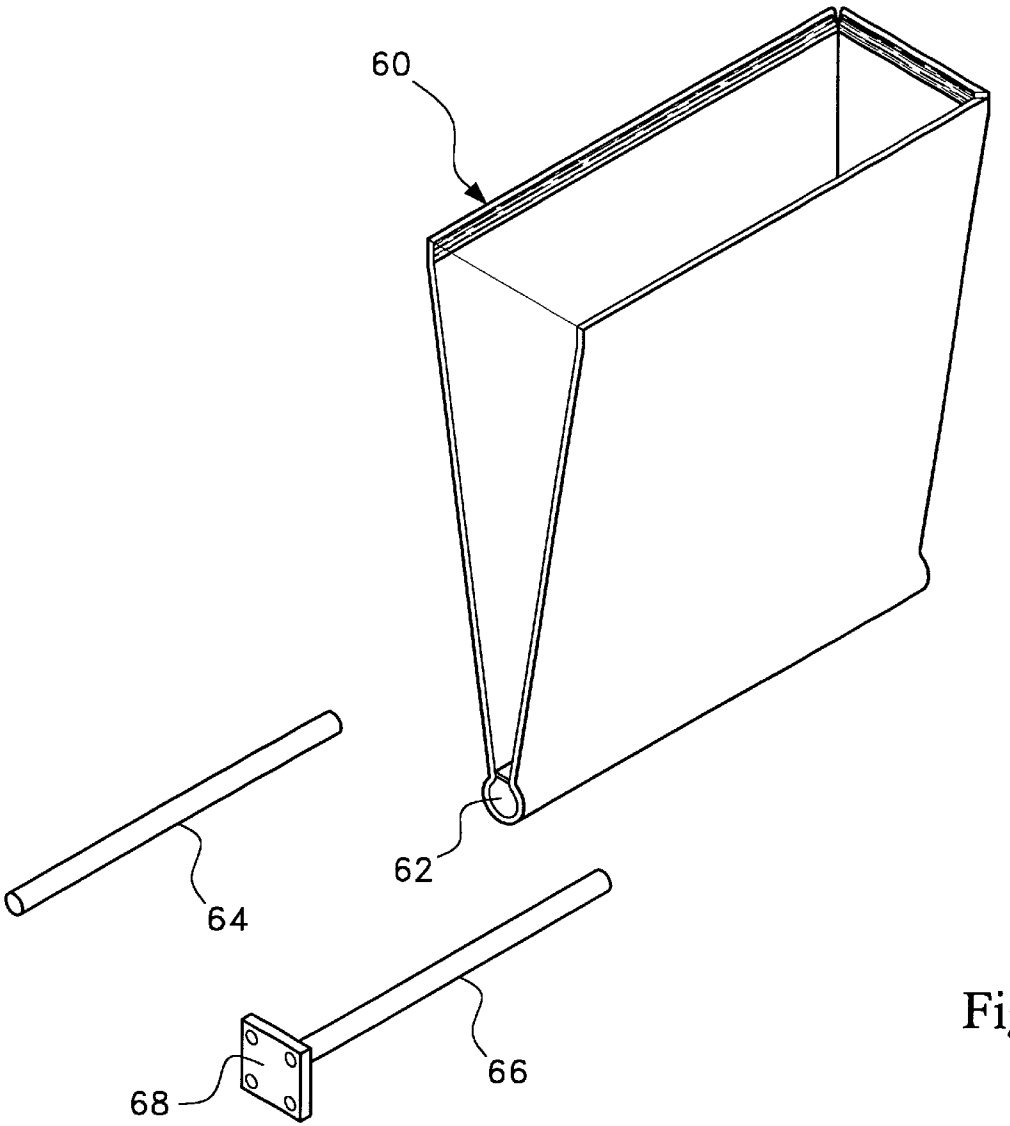
FIG. 4 is a rear perspective view of an alternate exemplary embodiment of the present invention.

Referring to FIG. 4, an alternate embodiment of the present invention system is shown. In this embodiment, the display flag 60 is not manufactured to hang in a rectangular shape. Rather, the display flag 60 is manufactured to hang in a wedge shape. At the bottom of the display flag 60 is formed a tubular conduit 62. The tubular conduit 62 is open facing a mail post. A weight 64 can be placed in the tubular conduit 62. Once present in the tubular conduit 62, the weight 64 maintains the bottom of the flag display 22 in the desired wedge shape. The weight 64 also prevents the flag display 60 from blowing freely in the wind and detaching from the mailbox.

Also shown in FIG. 4 is an optional bottom bracket 66 that can be used in place of the weight. The bottom bracket 66 has a mounting base 68 that connects to the vertical post 12 (FIG. 1) of the mailbox construction. The bottom bracket 66 engages the sewn conduit 62 at the bottom of the flag skirt 66. The bottom bracket 66 therefore maintains the bottom of the flag display 60 in the desired wedge shape while simultaneously anchoring the bottom of the flag display 60. The bottom bracket 66 can be made to be adjustable in length and/or width, so that one bottom bracket can be adapted for use with different flag displays.

Figure 5:
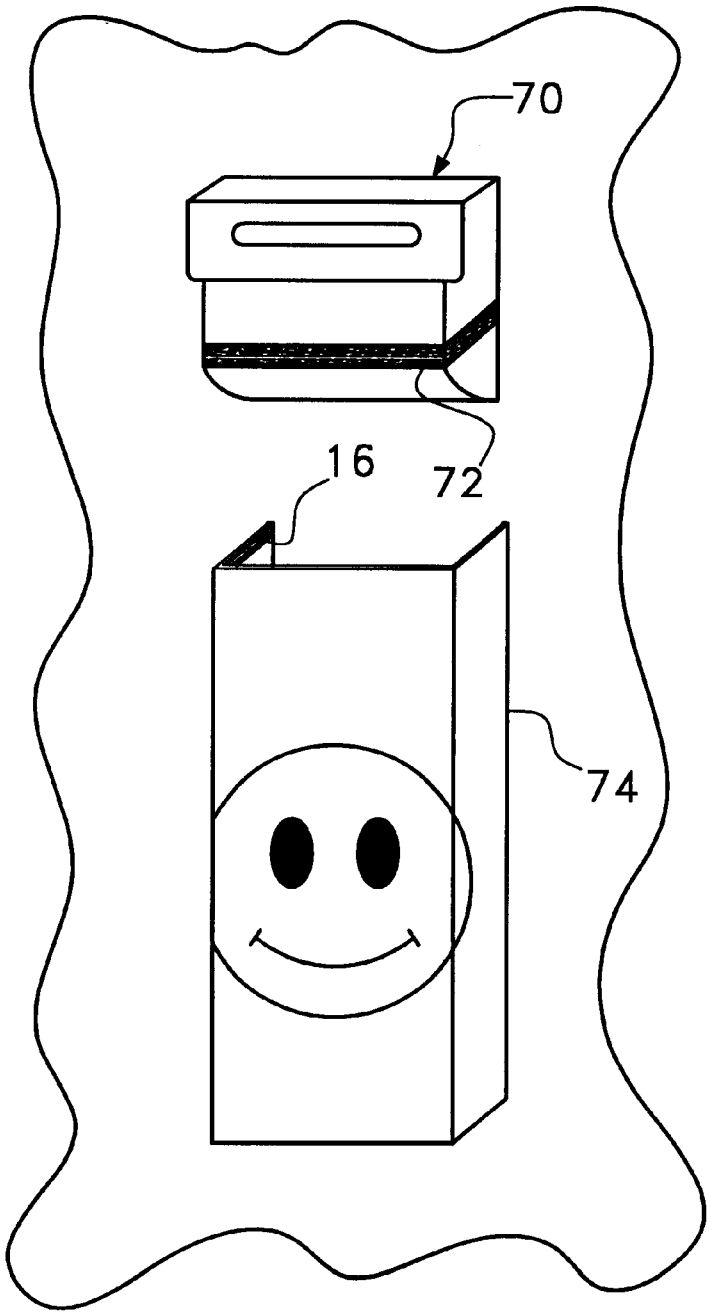
FIG. 5 is a perspective view of an alternate exemplary embodiment of the present invention shown in conjunction with a house mounted mailbox.

Referring to FIG. 5, a mailbox 70 is shown of the type that mounts to the exterior wall of a house. Onto this mailbox is attached a strip of hook and loop material or some other mechanical fastening system 72. The display flag 74 has a length equal to the three sides of the mailbox 70 that extend away from the wall of the house. A strip of hook and loop material or some other mechanical fastening system 76 is present on the inside surface of the display flag 74, near its top edge. The fasteners on the display flag 74 connect with the fasteners on the mailbox 70 and the display flag hangs from below the mailbox 70.

It will be understood that the specifics of the present invention described above illustrate only exemplary embodiments of the present invention. A person skilled in the art can therefore make numerous alterations and modifications to the shown embodiment utilizing functionally equivalent components to those shown and described. All such modifications are intended to be included within the scope of the present invention as defined by the appended claims.

What is claimed is:

1. An assembly, comprising:

a post;

a mailbox coupled to said post at a predetermined height, said mailbox having a base with a front surface and two side surfaces, wherein said front surface and said two side surfaces have a combined length;

a flag display having a top edge and a bottom edge, wherein said flag has a length equal to said combined length;

a mechanical fastening means disposed on said mailbox proximate said base and disposed on said flag display proximate said top edge, wherein said top edge of said flag display can be selectively attached to said mailbox so that said flag display hangs below said mailbox.

2. The assembly according to claim 1, further including a weight attached to said bottom edge of said flag display.

3. The assembly according to claim 2, wherein said weight has a rectangular configuration.

4. The assembly according to claim 1, further including a bracket for attaching said bottom edge of said flag display to said post.

5. The assembly according to claim 4, wherein said top edge of said flag display contains reliefs that enable the mailbox to be accessed when said flag display is attached to said mailbox.

6. The assembly according to claim 1, wherein said mechanical fastening means includes hook and loop fasteners affixed to both said top edge of said flag display and said mailbox.

7. The assembly according to claim 1, wherein said mechanical fastening means is selected from a group consisting of hook and loop material, snaps, grommets and hooks, laces and holes, and zippers.

8. A method of attaching an ornamental flag to a roadside mailbox, comprising the steps of:

attaching fasteners to the exterior of the mailbox, proximate its base, along at least three sides of the mailbox;

providing a flexible, woven, ornamental flag having a top edge and a bottom edge;

connecting said top edge of said ornamental flag to said fasteners, wherein said ornamental flag hangs below said at least three sides of the mailbox.

9. The method according to claim 8 further including the step of attaching a weight to the bottom edge of the ornamental flag.

10. The method according to claim 8, further including the step of attaching the bottom edge of the ornamental flag to a mailbox post.

11. The method according to claim 8, wherein said ornamental flag is attached to the mailbox utilizing a connection device selected from a group consisting of hook and loop material, snaps, hooks and grommets, laces and holes, and zippers.

12. An assembly, comprising:

a post;

a mailbox coupled to said post at a predetermined height, wherein said mailbox has a base and exterior surfaces;

a flag display having a top edge and a bottom edge;

a mechanical fastening means disposed on at least some of said exterior surfaces of said mailbox proximate said base and disposed on said flag display proximate said top edge, wherein said top edge of said flag display can be selectively attached to said mailbox so that said flag display hangs below said mailbox; and a bracket for attaching said bottom edge of said flag display to said post.

13. The assembly according to claim 12, wherein said mailbox has a front surface and two side surfaces and said flag display has a length equal to the combined length of said front surface and said two side surfaces.

14. The assembly according to claim 12, wherein said mechanical fastening means is selected from a group consisting of hook and loop material, snaps, grommets and hooks, laces and holes, and zippers.

* * * * *